US006744377B1

(12) United States Patent
Inoue

(10) Patent No.: US 6,744,377 B1
(45) Date of Patent: Jun. 1, 2004

(54) VEHICLE-MOUNTED APPARATUS OF A DEDICATED SHORT RANGE COMMUNICATIONS SYSTEM

(75) Inventor: Masahiro Inoue, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/269,940

(22) Filed: Oct. 15, 2002

(30) Foreign Application Priority Data

Apr. 12, 2002 (JP) ..... 2002-110616

(51) Int. Cl.[7] ..... G08G 1/065
(52) U.S. Cl. ..... 340/928; 235/384
(58) Field of Search ..... 340/928, 933–943, 340/10.1, 10.51, 10.4, 10.52, 10.56; 235/384, 380, 375, 382

(56) References Cited

U.S. PATENT DOCUMENTS 5,310,999 A * 5/1994 Claus et al. ..... 235/384
5,424,727 A * 6/1995 Shieh ..... 340/928
5,640,156 A * 6/1997 Okuda et al. ..... 340/928
5,962,833 A * 10/1999 Hayashi ..... 235/384
6,019,285 A * 2/2000 Isobe et al. ..... 235/384
6,252,524 B1 * 6/2001 Takikita ..... 340/933
6,337,622 B1 * 1/2002 Sugano ..... 340/438
6,339,384 B1 * 1/2002 Valdes-Rodriguez ..... 340/928
6,390,365 B1 * 5/2002 Karasawa ..... 235/384
6,396,418 B2 * 5/2002 Naito ..... 340/928
6,411,889 B1 * 6/2002 Mizunuma et al. ..... 701/117

* cited by examiner

*Primary Examiner*—Nina Tong
(74) *Attorney, Agent, or Firm*—Sughrue Mion, PLLC

(57) ABSTRACT

A vehicle-mounted apparatus of a dedicated short-range communications system is capable of informing a discount of an amount of toll to a user. The apparatus includes a radio communication part for communicating with road-side radio equipment, an IC card storing therein traffic histories, a control part for processing data received from the radio communication part, an account instruction part for generating an account instruction based on the data from the control part, a discount instruction part for generating a discount instruction based on the data from the control part, a display part and an audio part for informing an account and a discount to the user based on the instruction from the account instruction part and the instruction from the discount instruction part, and a buzzer part for notifying a condition of passage of a vehicle through a toll gate to the user by performing an account or a discount.

5 Claims, 6 Drawing Sheets

FIG. 5A

| | |
|---|---|
| AMOUNT OF DISCOUNT | ¥−350円 |

FIG. 5B

| | |
|---|---|
| INDICATION OF AMOUNT OF MONEY AFTER DISCOUNTED | ¥3250円 |

FIG. 5C

| | |
|---|---|
| INDICATION OF AMOUNT OF TOLLS USED FOR ONE DAY | ¥9820円 |

VEHICLE-MOUNTED APPARATUS OF A DEDICATED SHORT RANGE COMMUNICATIONS SYSTEM

BACKGROUND OF THE INVENTION

1. Field of the Invention

The present invention relates to a vehicle-mounted apparatus installed on a vehicle in a dedicated short-range communications (DSRC) system of an intelligent transport system (ITS), and more particularly, it relates to a vehicle-mounted apparatus of a dedicated short-range communications system which is capable of efficiently informing its user of information on an account or a discount.

2. Description of the Related Art

A dedicated short-range communications (DSRC) systems is widely used to perform communications only within a limited range on a road by using radio waves of the microwave band. Such a DSRC system is an effective system in which radio communications are carried out between a ground device arranged on a road and a vehicle-mounted or on-vehicle device installed on a vehicle, whereby various services such as toll collection, traffic and road information services, etc., can be provided by mutually transferring various types of data between the ground device and the on-vehicle devices, thus benefiting not only drivers but also administrators of roads, parking lots and so on.

As systems using DSRC, there have been thought various kinds of applications such as electronic toll collection (ETC) systems in expressways, charge collection systems in gas stations and drive throughs, traffic information services and so on. Among them, it is planned that such a system is used in applying a discount of a road charge or toll to a vehicle passing a specific route, as represented by environmental road pricing, etc., or in other applications in which a limited time discount, a customer discount or the like are applied. In this manner, DSRC systems are planned to be used in managing not only accounting (or billing) but also discounting in DSRC settlements in the future.

A known vehicle-mounted DSRC apparatus is constructed as shown in FIG. 6. As seen from this figure, radio wave data from unillustrated road-side radio equipment is demodulated by a radio communication part 1, and an analysis of the data is performed by a control part 2, so that data is sent from an account instruction part 3 to a display part 4 and an audio part 5, which together constitute an information means, in accordance with the data thus analyzed, thereby informing the user of his or her account information. In addition, there may be a case where when an account or radio communication has been ended normally, a "beep sound" or the like is generated from a buzzer part 6 to inform the user of the account or normal communication. An IC card 7 has account information such as dates and times, places (traffic gates), amounts of money, etc., stored in a built-in memory by means of an unillustrated writing part.

With such a known vehicle-mounted apparatus in a dedicated short-range communications system, however, there is no means for notifying the user of the fact that a discount has been made. In addition, it is impossible to determine only from hearing a buzzer sound whether an amount of toll charged is an account or a discounted one. As a result, there might be users who think an ordinary account has been charged even when they passed a discount toll gate. Accordingly, it is forecast that a great number of inquiries will rush to sales services.

Moreover, in order to know a total sum of tolls for one day or a total sum of tolls spent up to now, it is necessary for one to sum up respective amounts of tolls one by one. Besides, it takes time to calculate highway tolls when a plurality of people go out in a group, etc.

SUMMARY OF THE INVENTION

The present invention is intended to solve the problems as referred to above, and has for its object to provide a vehicle-mounted apparatus of a dedicated short-range communications system which is capable of informing its user of a discount in a reliable manner when the discount has been made.

Bearing the above object in mind, the present invention resides in a vehicle-mounted apparatus of a dedicated short-range communications system in an intelligent transport system which is capable of informing an account or a discount to a user. The apparatus includes a radio communication part for communicating with road-side radio equipment, an IC card storing therein a traffic history, a control part for processing data received from the radio communication part, an account instruction part for generating an account instruction based on the data from the control part, a discount instruction part for generating a discount instruction based on the data from the control part, information means in the form of a display part and an audio part for informing an account and a discount to the user based on the account instruction from the account instruction part and the discount instruction from the discount instruction part, and a buzzer part for notifying a condition of passage of a vehicle through a toll gate to the user by performing an account or a discount. According to the present invention, when a charge or toll is discounted, it is possible to inform the user of such a discount without fail, thus enabling the user to confirm the amount of discount in a reliable manner.

The above and other objects, features and advantages of the present invention will become more readily apparent to those skilled in the art from the following detailed description of preferred embodiments of the present invention taken in conjunction with the accompanying drawings.

BRIEF DESCRIPTION OF THE DRAWINGS

FIGS. 5A through 5C are explanatory views of display examples according to the present invention.

DESCRIPTION OF THE PREFERRED EMBODIMENTS

Hereinafter, preferred embodiments of the present invention will be described in detail while referring to the accompanying drawings.

Figure 1:
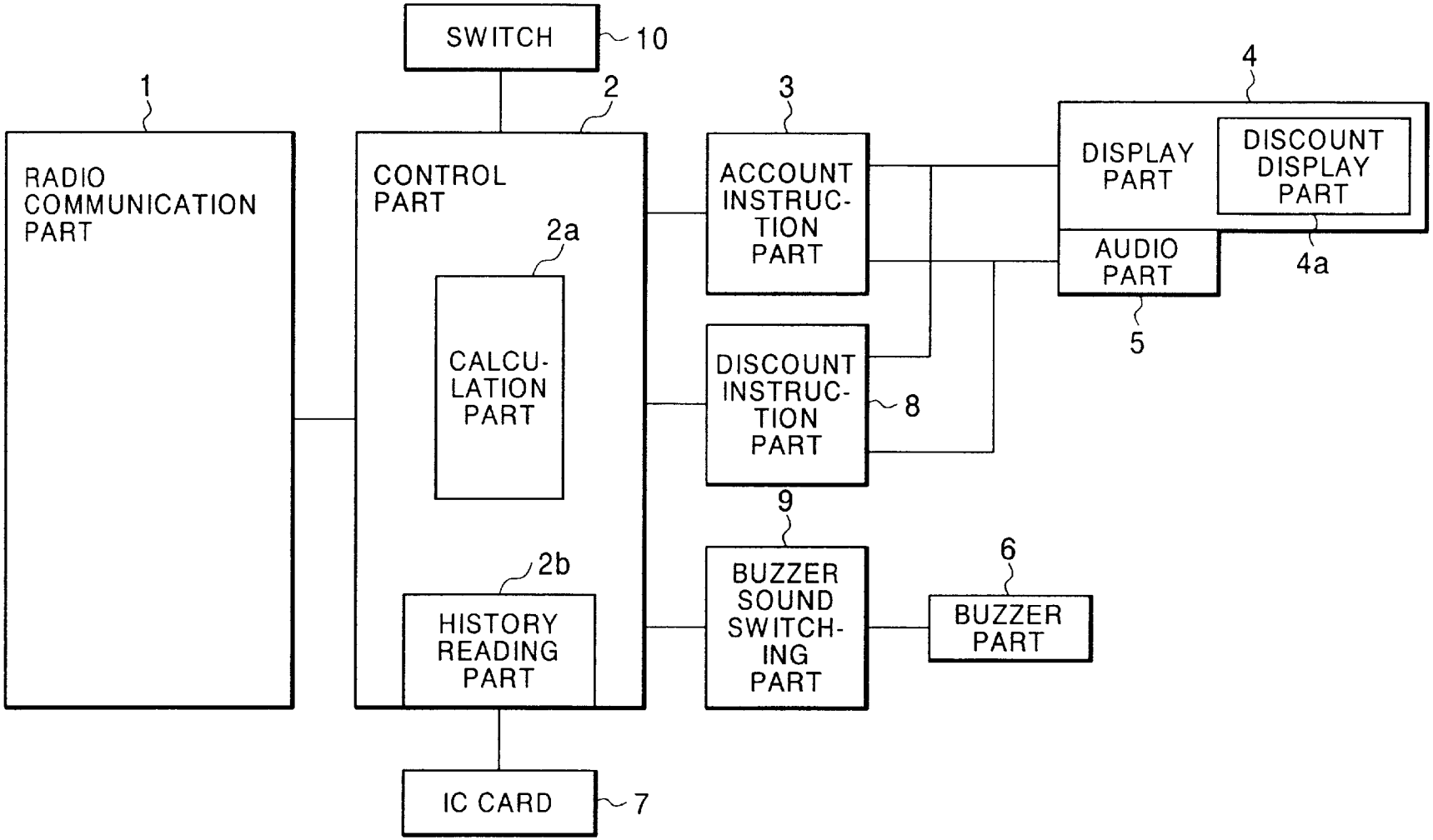
FIG. 1 is a block diagram showing the configuration of a vehicle-mounted apparatus of a dedicated short-range communications system according to the present invention.

FIG. 1 is a block diagram which shows the configuration of a vehicle-mounted apparatus of a dedicated short-range communications system according to the present invention. In FIG. 1, the vehicle-mounted apparatus includes a radio communication part 1 for communicating with unillustrated road-side radio equipment, a control part 2 for processing the data received from the radio communication part 1, an account instruction part 3 for instructing, based on the data from the control part 1, an account or a discount to an information means in the form of a display part 4 and an audio part 5 to be described later in detail, a display part 4 for visually informing a user of an account (billing), an audio part 5 for aurally informing the user of an account instruction, a buzzer part 6 for notifying the user of an account or a discount through a "beep sound" or the like, an IC card 7 for storing traffic histories, etc., a discount instruction part 8 for instructing a discount to the display part 4 and the audio part 5 in accordance with the data from the control part 2 as in the account instruction part 3, a buzzer sound switching part 9 for switching between a account buzzer sound and a discount buzzer sound, and a switch 10 for giving an instruction to the control part 2 when a history stored in the IC card 7 is read out. The display part 4 is provided with a discount display part 4*a* for displaying an indication of a discount. The control part 2 is provided with a calculation part 2*a* for calculating an account or a discount, and a history reading part 2*b* for reading out a history stored in the IC card 7.

Embodiment 1

Now, reference will be made to a vehicle-mounted apparatus of a dedicated short-range communications system according to a first embodiment of the present invention. In this first embodiment, the radio communication part 1, the control part 2, the account instruction part 3, the display part 4, the buzzer part 6, and the discount instruction part 8 in the configuration shown in FIG. 1 are employed to construct the vehicle-mounted apparatus.

The concrete operation of this embodiment will be described below. When a vehicle passes a toll gate, data from the radio communication part 1 is processed by the control part 2, and as a result, if the data indicates an account, an amount of account is displayed by the display part 4 under the control of the account instruction part 3, and the amount of account is told or uttered by the audio part 5. On the other hand, if the data indicates a discount, an amount of discount is displayed by the discount display part 4*a* of the display part 4 and told or uttered by the audio part 5 under the control of the discount instruction part 8. When the account or discount processing has been carried out to permit the vehicle to pass the toll gate, the buzzer part 6 is controlled to generate a "beep sound" or the like for instance based on the control of the control part 2.

Thus, according to the first embodiment, it is possible to inform, upon discounting, the user of the discount in a reliable manner by means of the display part 4 provided with the discount display part 4*a* or the audio part 5. As a consequence, the user is able to confirm the amount of discount in a reliable manner.

Embodiment 2

In a second embodiment of the present invention, switching can be made between an account buzzer sound indicative of an account operation and a discount buzzer sound indicative of a discount operation by using the buzzer sound switching part 9 in addition to the same components of the first embodiment, as shown in FIG. 1. That is, for example, the buzzer part 6 is controlled by the buzzer sound switching part 9 in such a manner that a single beep sound consisting of one "beep" is generated in case of an account, whereas a series of beep sounds consisting of three "beeps" (e.g., "beep", "beep", "beep") are generated in case of a discount.

Thus, according to the second embodiment, it is possible to instantaneously inform the user of an account or a discount by changing the sound of the buzzer part 6 for the account or discount by means of the buzzer sound switching part 9. As a result, it becomes unnecessary to particularly confirm the display visually, thus improving safety during operation of the vehicle.

Embodiment 3

In a third embodiment of the present invention, it is possible to increase convenience in use by informing the user of an amount of money charged after discounted while using the IC card 7 and the calculation part 2*a* and the history reading part 2*b* of the control part 2 in addition to the same components of the second embodiment, as shown in FIG. 1.

That is, in case where an account is made when a vehicle passes a toll gate, an amount of the current toll now charged is displayed by the display part 4 and told or uttered by the audio part 5 as in the preceding ones. However, in case of a discount, an amount of the last toll stored in the IC card 7 is read out by the history reading part 2*b* in the control part 2, so that an amount of the current toll after discounted is calculated from an amount of discount for the current use and the amount of the last toll read out from the IC card 7 by means of the calculation part 2*a*. The usage charge after discounted is displayed by the display part 4 and told or uttered by the audio part 5 under the control of the account instruction part 3 or the discount instruction part 8.

Figure 2:
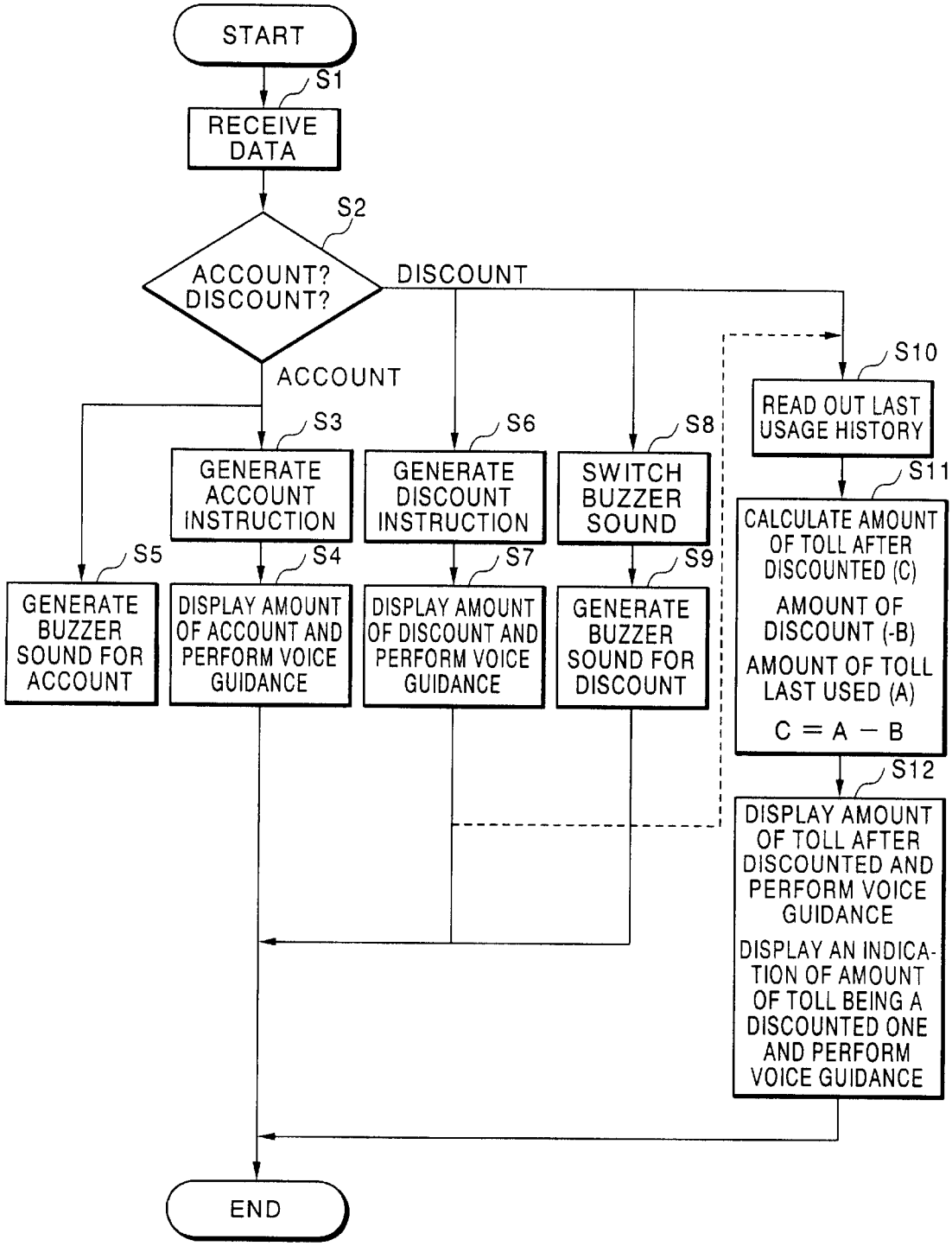
FIG. 2 is a flow chart explaining the operation a vehicle-mounted apparatus of a dedicated short-range communications system according to a third embodiment of the present invention.

The display and utterance of the amount of toll after discounted may be carried out after the amount of discount has once been displayed and uttered or without displaying and uttering it. Hereinafter, the operation of the third embodiment will be described while referring to a flow chart of FIG. 2. As shown in this figure, the control part 2 receives data through the radio communication part 1 (step S1), as a result of which, if the data indicates an account, the control part 2 displays the amount of account at the display part 4 and utters it at the audio part 5 under the control of the account instruction part 3. At the same time, a buzzer sound for account is generated by the buzzer part 6 (steps S2–S5).

On the other hand, if the data indicates a discount, an amount of discount is displayed by the discount display part 4*a* of the display part 4 (see FIG. 5A), and uttered by the audio part 5 under the control of the discount instruction part 8, and a buzzer sound for discount, which is different from one for account, is generated by the buzzer part 6 through the control of the buzzer sound switching part 9 (steps S2→S6–S9).

In addition, in case of a discount, an amount of the last toll stored in the IC card 7 is read out by the history reading part 2*b* in the control part 2 (step S10). An amount of toll after discounted (C=A−B) is calculated from the amount of discount (−B) for the current use and the amount of the last toll (A) read out from the IC card 7 by means of the calculation part 2*a*. The discounted usage charge thus calculated is displayed by the display part 4 (step S11 and FIG. 5B), and uttered by the audio part 5 (step S12) under the control of the account instruction part 3 or the discount instruction part 8.

Thus, according to the third embodiment, the convenience in use can be increased by notifying the user of the amount of toll after discounted.

Embodiment 4

Further, in order to distinguish an amount of discounted toll from an amount of ordinary toll when an amount of toll is displayed, the display part 4 is provided with an icon part for indicating the content of an amount of money displayed. If a discount icon indicating that the displayed amount is an amount of money after discounted is displayed, the convenience in use is further increased.

Thus, according to the fourth embodiment, owing to an arrangement that the display part 4 is provided with the icon part indicating the content of an amount of money displayed, it is possible to distinguish an amount of ordinary toll from an amount of discounted toll upon displaying an amount of toll, thereby enabling the user to understand for what the amount of money displayed is. As a consequence, the user can be given a sense of easiness or relief.

Embodiment 5

In a fifth embodiment of the present invention, by using the switch 10 in addition to the same components of the third embodiment, as shown in FIG. 1, it is possible to notify the user of a distinction between a discount and an account as well as the meaning of an amount of money displayed, etc., when the user confirms his or her usage history through a switch input during operation of a vehicle, and to enable the user to confirm the history after the end of the operation of the vehicle through the same display and utterance as in the operation of the vehicle.

That is, when a history is confirmed through operation of the switch 10 by the user, a history stored in the IC card 7 is read out by the history reading part 2*b* of the control part 2 with the input of the switch 10 being made a trigger. In this case, if the history thus read out indicates a discount, a former history of the discount is read out again, and the charge or toll after discounted is calculated by the calculation part 2*a* in the control part 2, and informed to the user by means of the display part 4 and the audio part 5.

In addition, a total sum of tolls for the same day or a total sum of tolls up to now (e.g., the last two days), if requested through an input of the switch 10, can be calculated by confirming the date or dates in the usage history by means of the calculation part 2*a*, and it is then displayed or uttered by the display part 4 or the audio part 5 under the instruction of the account instruction part 3 or the discount instruction part 8. At this time, an icon indicating a total amount of money for one day, i.e., an icon indicating that a total sum of tolls for the whole day is displayed, may be displayed.

Figure 3:
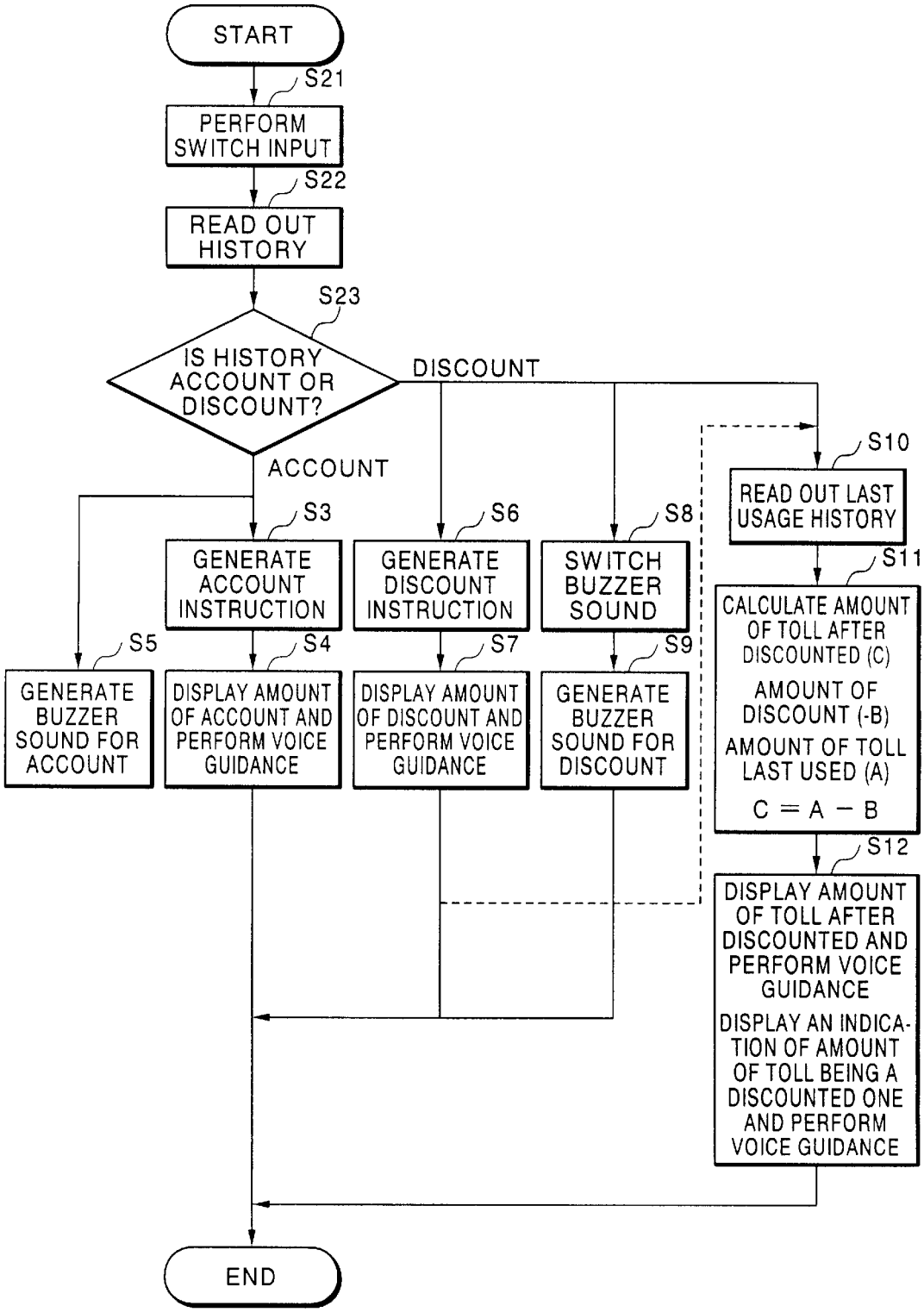
FIG. 3 is a flow chart explaining the operation a vehicle-mounted apparatus of a dedicated short-range communications system according to a fifth embodiment of the present invention.

Hereinafter, the operation of the fifth embodiment will be described while referring to flow charts of FIG. 3 and FIG. 4. First of all, as shown in FIG. 3, when the switch 10 is input or operated by the user, the control part 2 reads out a history stored in the IC card 7 by means of the history reading part 2*b* with the input of the switch 10 being made a trigger, and determines whether the history thus read out is an account or a discount (steps S21–S23).

Figure 4:
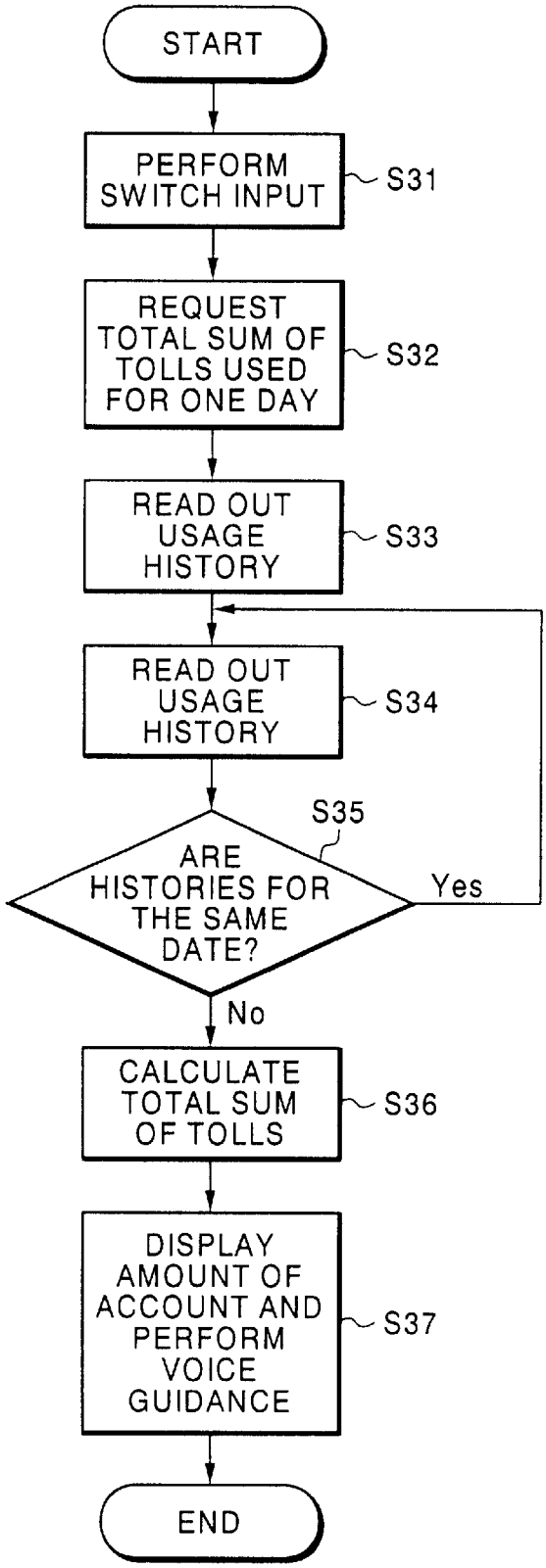
FIG. 4 is a flow chart explaining the operation of the apparatus according to the fifth embodiment of the present invention.
Figure 6:
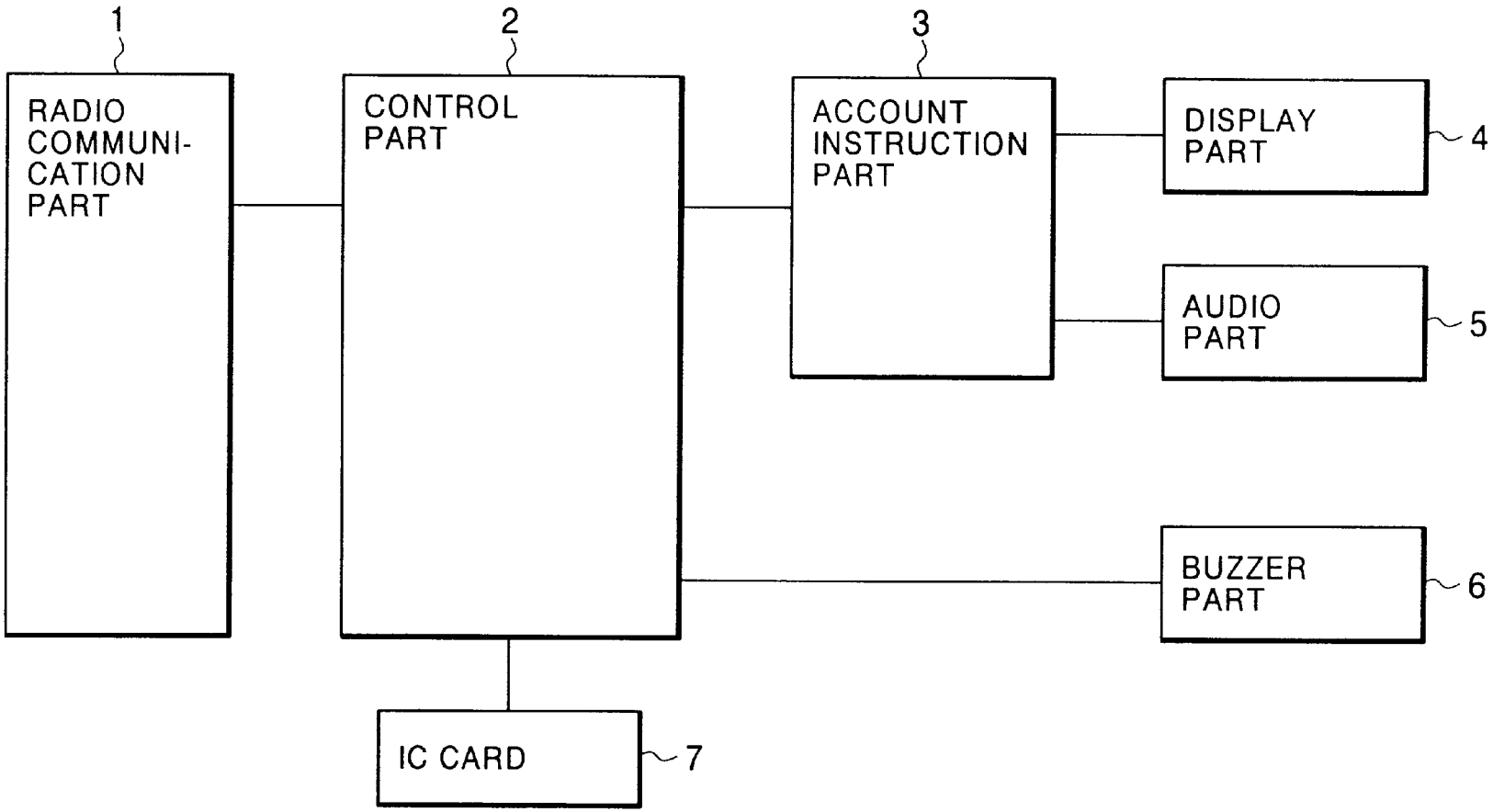
FIG. 6 is a block diagram showing a known vehicle-mounted apparatus of a dedicated short-range communications system.

Also, if a total amount of money or tolls used for one and the same day is requested through an input of the switch 10, it is calculated by confirming that date in the read-out usage histories by means of the calculation part 2*a*, as shown in FIG. 4, and displayed or uttered by the display part 4 or the audio part 5 under the instruction of the account instruction part 3 or the discount instruction part 8 (steps S31–S37 (see FIG. 5C)). Here, note that an explanation about how to operate the switch 10 for requesting amounts of money or tolls used for the same day, etc., is irrelevant to the present invention and hence omitted.

Thus, according to the fifth embodiment, when the user confirms his or her usage history through a switch input, a distinction between a discount and an account, the meaning of an amount of money displayed, etc., can be notified to the user, so that after the operation of a vehicle is stopped or ended, the user is able to confirm the histories through the same display and utterance as those during the operation of the vehicle.

As described above, according to the present invention, when a charge or toll is discounted, it is possible to inform the user of such a discount without fail, thus enabling the user to confirm the amount of discount in a reliable manner.

In addition, it is possible to notify the user of an account or a discount instantaneously by changing a buzzer sound for account into one for discount or vice versa. As a result, in particular, it becomes unnecessary for the user to visually confirm the display, thereby making it possible to improve safety in driving the vehicle.

Moreover, by notifying the user of an amount of used toll or charge after discounted, the convenience in use can be increased.

Further, since a display part may be provided with an icon part for indicating the content of an amount of money displayed, it is possible to make a distinction between an amount of money ordinarily charged and an amount of money discounted, thus enabling the user to understand what an amount of money is displayed for. As a result, the user can be given a sense of easiness or relief.

Furthermore, when the user confirms his or her usage history through a switch input, a distinction between a discount and an account, the meaning of an amount of money displayed and the like can be notified to the user so that after the driver stops driving the vehicle, the user can confirm the usage histories through the same display and utterance as those during driving the vehicle.

While the invention has been described in terms of preferred embodiments, those skilled in the art will recognize that the invention can be practiced with modifications within the spirit and scope of the appended claims.

What is claimed is:

1. A vehicle-mounted apparatus of a dedicated short-range communications system in an intelligent transport system, said apparatus comprising:

a radio communication part for communicating with road-side radio equipment;

a control part for processing data received from said road-side radio equipment via said radio communication part to determine an toll amount to be charged to an account of a user and a discount amount applied to said toll amount;

an account instruction part for generating an account instruction based on first control data from said control part;

a discount instruction part for generating a discount instruction based on second control data from said control part;

information means for informing the user of said toll amount and said discount amount based on the account instruction from said account instruction part and the discount instruction from said discount instruction part; and a buzzer part for notifying the user of a condition of passage of a vehicle through a toll gate resulting in determination of said toll amount or said discount amount by said control part based on third control data from said control part.

2. The vehicle-mounted apparatus of a dedicated short-range communications system according to claim 1, further comprising a buzzer sound switching part for receiving the third control data from the control part and controlling said buzzer part to switch between generating a first buzzer sound when said discount amount is applied to said toll amount and a second buzzer sound when said discount amount is not applied to said toll amount.

3. The vehicle-mounted apparatus of a dedicated short-range communications system according to claim 1, further comprising an IC card storing therein traffic histories, wherein said control part comprises:

a history reading part for reading out a toll history of said user account from said IC card; and a calculation part for calculating said toll amount charged to said account based on said discount amount and a previous toll amount from said IC card and read out therefrom by said history reading part.

4. The vehicle-mounted apparatus of a dedicated short-range communications system according to claim 3, further comprising an input switch operable by a user for displaying the toll history of the user by manually triggering said history reading part and said calculation part.

5. The vehicle-mounted apparatus of a dedicated short-range communications system according to claim 1, wherein said information means comprises a display part for displaying said toll amount, said display part being provided with an icon part for indicating whether said discount amount has been applied to a displayed toll amount.

* * * * *